US008734578B2

(12) United States Patent
Miki et al.

(10) Patent No.: US 8,734,578 B2
(45) Date of Patent: May 27, 2014

(54) DUST COLLECTING SYSTEM

(75) Inventors: Tadashi Miki, Osaka (JP); Masami Fukumoto, Osaka (JP); Osamu Eguchi, Shiga (JP); Yasuhiro Umekage, Shiga (JP); Kazuhiro Kuroyama, Osaka (JP); Hiroaki Kurihara, Shiga (JP)

(73) Assignee: Panasonic Corporation, Osaka (JP)

( * ) Notice: Subject to any disclaimer, the term of this patent is extended or adjusted under 35 U.S.C. 154(b) by 65 days.

(21) Appl. No.: 13/508,863

(22) PCT Filed: Nov. 8, 2010

(86) PCT No.: PCT/JP2010/070245

§ 371 (c)(1), (2), (4) Date: May 9, 2012

(87) PCT Pub. No.: WO2011/059077

PCT Pub. Date: May 19, 2011

(65) Prior Publication Data

US 2012/0234179 A1 Sep. 20, 2012

(30) Foreign Application Priority Data

Nov. 12, 2009 (JP) ..... 2009-258604

(51) Int. Cl.
*B01D 46/00* (2006.01)

(52) U.S. Cl.
USPC ..... 96/397; 55/383; 55/385.2; 55/467; 55/DIG. 29; 55/DIG. 34; 96/399; 96/417; 96/422; 454/192; 700/273

(58) Field of Classification Search
USPC ..... 55/385.1, DIG. 34; 250/342; 340/552, 340/541, 573, 565; 454/319, 75; 236/49.3, 236/51, 91 C, 91 E; 62/180, 186, 208, 209; 96/417
See application file for complete search history.

(56) References Cited

U.S. PATENT DOCUMENTS

| | | | | |
|---|---|---|---|---|
| 4,386,733 | A | 6/1983 | Bradshaw | |
| 5,703,367 | A * | 12/1997 | Hashimoto et al. | 250/342 |
| 6,137,407 | A * | 10/2000 | Akagawa et al. | 340/552 |
| 6,202,934 | B1 * | 3/2001 | Kamiya et al. | 236/91 C |
| 6,715,689 | B1 * | 4/2004 | Lee et al. | 236/49.3 |

FOREIGN PATENT DOCUMENTS

| | | |
|---|---|---|
| JP | 2008-267795 | 11/2008 |
| WO | WO 2009/125558 | 10/2009 |

* cited by examiner

*Primary Examiner* — Duane Smith
*Assistant Examiner* — Minh-Chau Pham
(74) *Attorney, Agent, or Firm* — Hamre, Schumann, Mueller & Larson, P.C.

(57) ABSTRACT

An indoor dust collecting system includes an air conditioner having an indoor unit that generates an air current, a dust collector, and a controller for controlling the air current from the indoor unit. A moving body detector is provided to detect a moving body such as, for example, a person, a pet, a cleaning robot, and the like. The air current from the indoor unit is controlled by the controller based on the position of the indoor unit, the position of a spot of occurrence of dust detected by the moving body detector, and the position of the dust collector such that the air current from the indoor unit reaches the dust collector via the spot of occurrence of dust in order for the dust collector to effectively suck the dust.

11 Claims, 7 Drawing Sheets

*Fig. 6*

| Position of Dust Collector | Direction of Dust Collector | Position of Indoor Unit | Direction of Indoor Unit | 1st Sensor | 2nd Sensor | 3rd Sensor | Wind Direction |
|---|---|---|---|---|---|---|---|
| C-IV | IV→I | A-I | I→IV | ON | ON | ON | Forward |
| C-IV | IV→I | A-I | I→IV | OFF | OFF | ON | Leftward |
| . . . | . . . | | | | | | |
| . . . | | | | | | | |
| | | | | | | . . . | . . . |
| | | | | | | . . . | . . . |

DUST COLLECTING SYSTEM

TECHNICAL FIELD

The present invention relates to a dust collecting system for cleaning an interior of a room and, in particular, to a technique for controlling an air current to efficiently collect dust by conveying an air current from an air conditioner toward a dust collector.

BACKGROUND ART

A conventional dust collecting system has been proposed having a temperature control apparatus as typified by an air conditioner and a dust collector such as an air cleaner, both of which are disposed inside a room to cooperate with each other (see, for example, Patent Document 1).

In the dust collecting system as disclosed in Patent Document 1, a signal from a dirt sensor mounted on the temperature control apparatus (hereinafter referred to as "air conditioner") is sent to the air cleaner (hereinafter referred to as "dust collector") via a communicative means so that the dust collector may be brought into operation based on the signal from the dirt sensor for cooperation with the air conditioner.

Because the dust collector is provided with its own dirt sensor positioned adjacent a floor face, the dust collector can obtain information on dirt at a high level where the air conditioner is normally installed, in addition to information on dirt at a low level close to the floor face. Accordingly, the dust collector can be operated upon detection of the degree of dirt at different levels.

Patent Document 1: Japanese Laid-Open Patent Publication No. 2008-267795

SUMMARY OF THE INVENTION

Problems to be Solved by the Invention

Although the above-described conventional construction can control the operation timing of the dust collector upon detection of the degree of dirt in a wide range of height using information from the two dirt sensors, it is not possible to control the direction of air discharged from the air conditioner so that the dust collector can efficiently collect dust, which would be generated by people's movements, opening and closing of a door, or movements of a moving body such as a cleaning robot.

A wind direction control for blindly conveying air toward a spot of occurrence of dust where dust is raised by, for example, people's movements may lower the dust collecting efficiency, because such dust is moved leeward by the air conditioner, and if air discharged from the air conditioner impinges on a wall, the air turns into a descending air current to promote falling of dust.

That is, unless the wind direction is controlled in consideration of the position of the air conditioner, the spot of occurrence of dust where a moving body such as a person is present, and the position of the dust collector, the dust collecting efficiency is lowered.

The present invention has been developed to overcome the above-described disadvantages.

It is accordingly an objective of the present invention to provide an indoor dust collecting system that enables a dust collector to efficiently collect dust generated by, for example, people's movements by controlling the wind direction in consideration of the position of an air conditioner that generates an air current, the spot of occurrence of dust such as the position of a person detected by a moving body detector, and the position of a dust collector.

Means to Solve the Problems

In accomplishing the above objective, a dust collecting system according to the present invention includes an air conditioner having an indoor unit that includes an air blowing means operable to generate an air current and a wind direction control means operable to control a direction of air blown out by the air blowing means, and a dust collector having a dust collecting means operable to collect dust, which moves with an indoor air current, by suction and discharge air into a room to thereby generate another air current. The air conditioner also has a moving body detecting means operable to detect a moving body that generates dust with movements thereof, the moving body detecting means transmitting a signal to the indoor unit upon detection of a moving body. The wind direction control means controls a wind direction to convey air from the indoor unit toward the dust collector via a spot where a moving body has been detected by the moving body detecting means.

Effects of the Invention

According to the present invention, dust generated by, for example, people's movements is efficiently collected and removed by causing the air current from the air conditioner to convey the dust to a place in the vicinity of the dust collector. Accordingly, the dust collecting system can positively and effectively remove dust in an entire room, thus making it possible to further enhance comfort in the room.

BRIEF DESCRIPTION OF THE DRAWINGS

FIG. 6 is a wind direction determination table for use in determining the wind direction from the air conditioner.

BEST MODE FOR CARRYING OUT THE INVENTION

Figure 1:
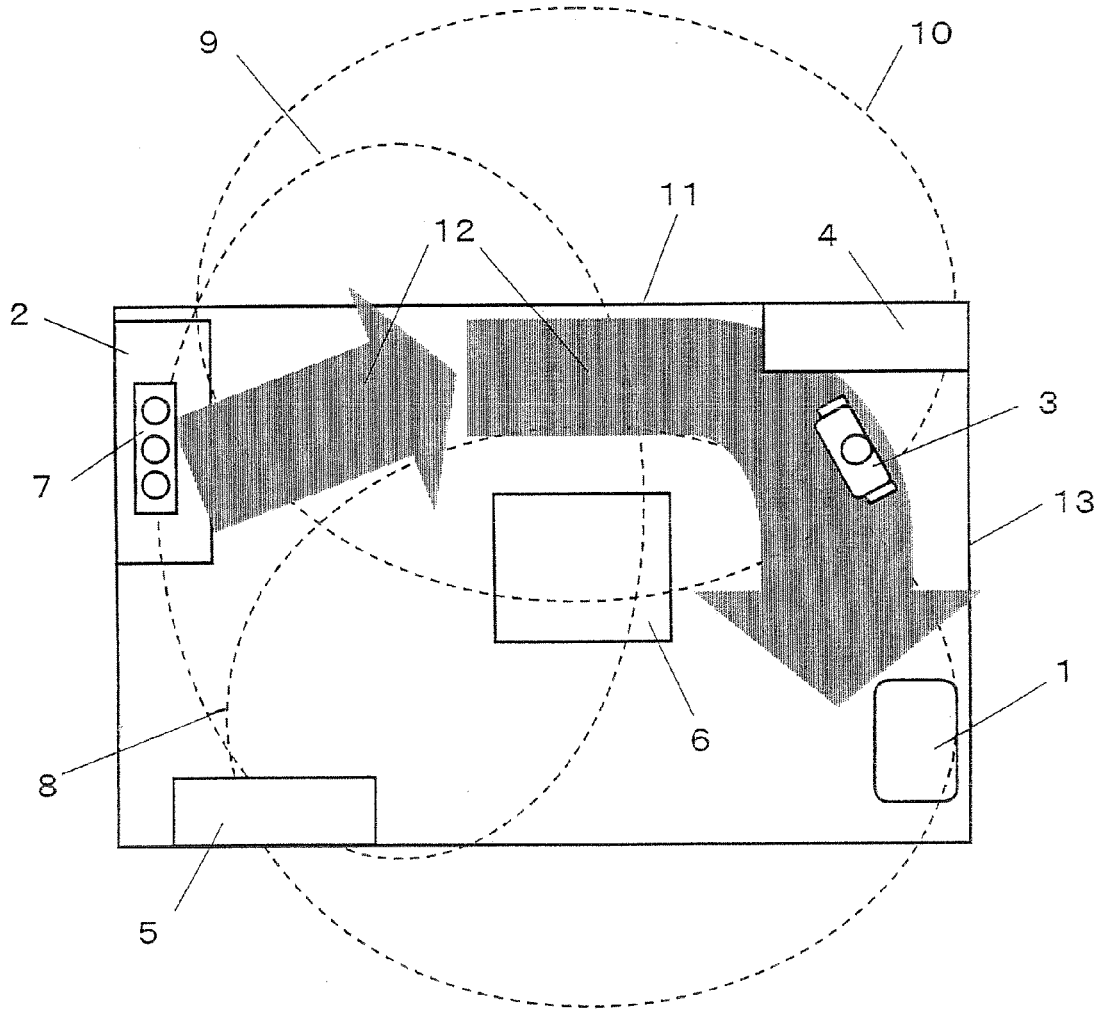
FIG. 1 is a top plan view of a room in which an indoor dust collecting system according to the present invention has been installed, showing an example of an air current in the room.

The present invention is directed to an indoor dust collecting system including an air conditioner having an indoor unit and a dust collector. The indoor unit includes an air blowing means operable to generate an air current and a wind direction control means operable to control a direction of air blown out by the air blowing means, while the dust collector has a dust collecting means operable to collect dust, which moves with an indoor air current, by suction and discharge air into a room to thereby generate another air current. The air conditioner also has a moving body detecting means operable to detect a moving body that generates dust with movements thereof, the moving body detecting means transmitting a signal to the indoor unit upon detection of a moving body. The wind direction control means controls a wind direction to convey air from the indoor unit toward the dust collector via a spot where a moving body has been detected by the moving body detecting means.

This construction can realize the dust collecting system capable of positively and effectively collecting and removing dust generated by, for example, people's movements by causing the air current from the air conditioner to convey the dust to a place in the vicinity of the dust collector.

The indoor unit also includes an obstacle detecting means operable to detect an obstacle in the room. When the obstacle detecting means detects an obstacle in a path from the indoor unit to the dust collector via the spot detected by the moving body detecting means, air from the indoor unit is conveyed to the dust collector along a wall or furniture while avoiding the obstacle. This construction allows the dust collecting system to collect dust more efficiently without being affected by a layout of, for example, furniture in the room.

The moving body detecting means includes a human body detecting sensor operable to detect infrared rays emitted from a human body, and the spot where a moving body has been detected by the human body detecting sensor is regarded as a spot of occurrence of dust. This construction also allows the dust collecting system to more efficiently collect dust from cloths of a person that are recognized as a major cause of generation of dust or dust generated by movements of the person.

Alternatively, the moving body detecting means includes an ultrasonic sensor operable to emit an ultrasonic wave and detect a reflected wave thereof, and the spot where a moving body has been detected by the ultrasonic sensor is regarded as a spot of occurrence of dust. This construction also allows the dust collecting system to more efficiently collect dust because a moving body such as a cleaning robot, a door or the like that generates dust can be detected, in addition to a moving body such as a human body, a pet or the like that emits infrared rays.

The obstacle detecting means can change a direction of emission of the ultrasonic wave and detects an obstacle by measuring a time period from when the ultrasonic wave has been emitted till when a reflected wave thereof is received in each direction. Because the obstacle detecting means can correctly detect the obstacle, the dust collecting system can determine a path of conveyance of air effective for dust removal.

Advantageously, when a determination is made that the wind direction control means cannot control the air current generated by the air blowing means to reach the duct collector via the spot where a moving body has been detected by the moving body detecting means, no air is blown out by the air blowing means. By so doing, if there is no appropriate direction of conveyance of air, the dust collecting system does not unavailingly blow air so as not to lower the dust collecting efficiency.

A duration during which air is blown is determined based on a length of a path from the indoor unit to the dust collector via the spot detected by the moving body detecting means. This feature makes the dust collecting system most effective in terms of the dust collecting efficiency and the power consumption.

Preferably, the dust collector further includes a dust sensor operable to detect an amount of dust, and the duration during which air is blown is determined based on a time change of a detection value of the dust sensor. This feature also makes the dust collecting system most effective in terms of the dust collecting efficiency and the power consumption.

In another aspect of the present invention, a dust collector is operable to cooperate with an indoor unit of an air conditioner, wherein the indoor unit includes an air blowing means operable to generate an air current and a wind direction control means operable to control a direction of air blown out by the air blowing means, and the air conditioner has a moving body detecting means operable to detect a moving body that generates dust with movements thereof, the moving body detecting means transmitting a signal to the indoor unit upon detection of a moving body. The dust collector includes a communicative means operable to transmit to and receive from the indoor unit a telegraphic message of a form identical to that of a remote controller that is used to remotely control the indoor unit, a dust collecting means operable to collect dust, which moves with an indoor air current, by suction and discharge air into a room to thereby generate another air current, and a control means operable to control the wind direction control means via the communicative means to convey air from the indoor unit toward the dust collector via a spot where a moving body has been detected by the moving body detecting means.

The dust collector of this construction can realize a dust collecting system capable of efficiently collecting and removing dust because the air current from the air conditioner conveys dust generated by people's movements to a place in the vicinity of the dust collector.

The present invention is also directed to a program given to a computer that controls the indoor dust collecting system or the dust collector of the above-described type.

EMBODIMENT 1

FIG. 1 depicts a room as viewed from above in which an indoor dust collecting system according to the present invention has been installed.

As shown in FIG. 1, the indoor dust collecting system includes a dust collector 1 disposed adjacent a wall 13 and an indoor unit 2 of an air conditioner mounted on a wall that confronts the wall 13. The room accommodates furniture such as a rack 4, a chest of drawers or wardrobe 5, and a table 6. In this embodiment, a person 3 is present, as a moving body that generates dust, in the room. That is, movements of the person 3 raise dust adhering to his or her cloths, dust from fibers of the cloths, and dust accumulated on a floor or furniture. In order to detect the movements of the person 3, the indoor unit 2 includes a moving body detecting means or dust generation spot detecting means having a human body detector 7 that detects infrared rays emitted from a human body to detect the person 3. The dust generation spot detecting means may be integrated into the indoor unit 2, as shown in FIG. 1, or placed separately. Alternatively, the dust collecting system can obtain information from human body detecting sensors mounted to a lighting fixture because it is predicted that network household appliances having a communicative means for exchange of information with other network household appliances will spread.

In addition to the human body, an animal such as a pet, a door, or a moving equipment such as a cleaning robot is also a moving body that generates dust. Accordingly, a moving body detecting means including a distance sensor such as, for example, an ultrasonic sensor or a laser capable of measuring a distance to an object can effectively detect a moving body that cannot be detected by the human body detecting sensors detecting thermal infrared rays from a human body or a pet.

The human body detector 7 shown in FIG. 1 is made up of a plurality of (for example, three) human body detecting sensors, each of which covers an oval-shaped detectable region 8, 9 or 10 indicated by a broken line. When a person enters one of the detectable regions 8, 9, 10, a corresponding one of the human body detecting sensors outputs a signal.

If a person is present in an area where two or more of the detectable regions 8, 9, 10 overlap, two or more human body detecting sensors output respective signals. By way of example, if the person 3 is standing in an area adjacent the table 6 on a side of the indoor unit 2 where all the detectable regions 8, 9, 10 overlap, the three human body detecting sensors output respective signals, by which a determination is made that the person 3 is present by the table 6 on the side of the indoor unit 2.

In FIG. 1, an air current 12 from the indoor unit 2 is indicated by thick arrows. In the illustrated example, the person 3 is present in the detectable region 10 and, hence, only one of the human body detecting sensors that is positioned on the right (upper side in FIG. 1) as viewed toward the indoor unit 2 outputs a signal, by which a determination is made that the person 3 is present in the vicinity of the rack 4.

Figure 2:
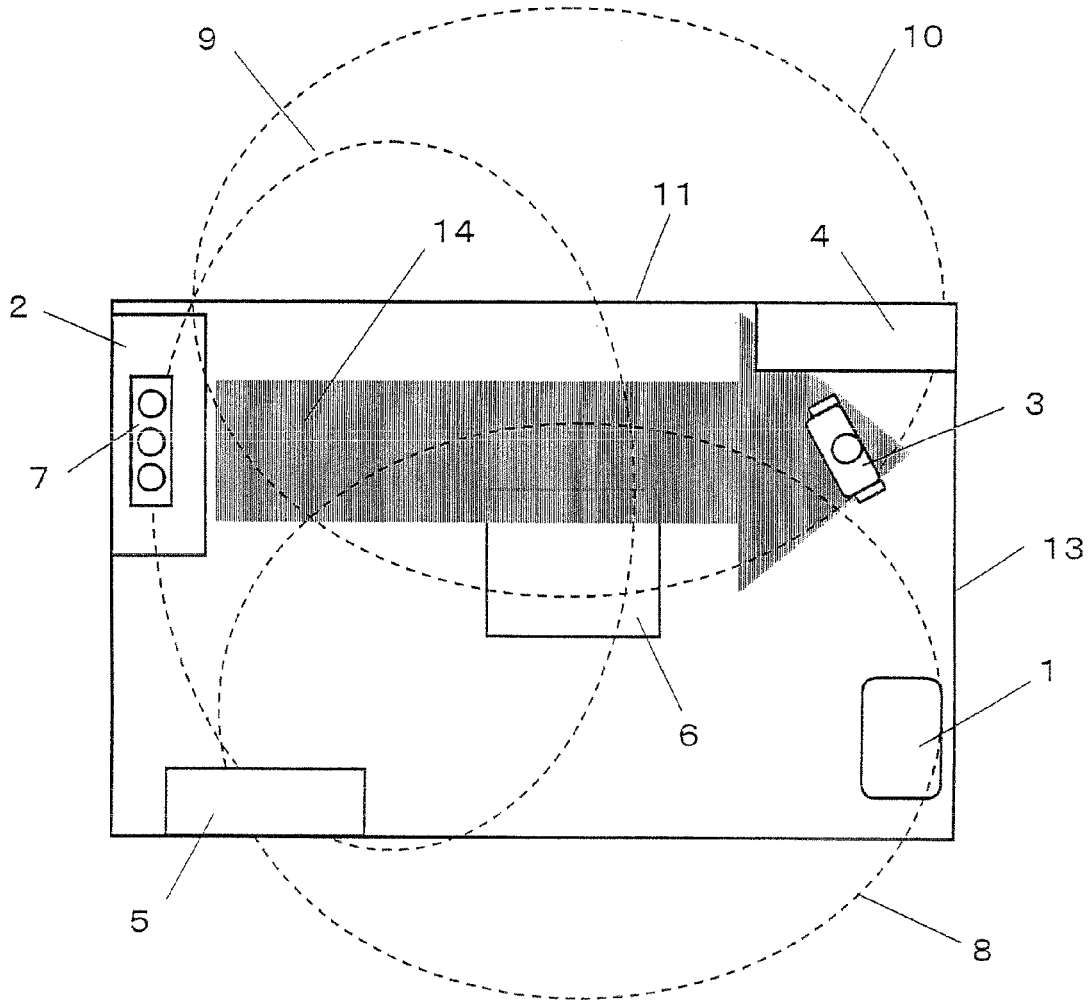
FIG. 2 is a top plan view of the room in which the indoor dust collecting system according to the present invention has been installed, showing another example of the air current in the room.

A control of the air current 12 according to the present invention is explained hereinafter, compared with a generally known example as shown in FIG. 2.

According to the present invention, the air current 12 is controlled to be directed toward the dust collector 1 via a spot adjacent the table 6 where the person 3 has been detected by the human body detector 7, while in the example of FIG. 2, an air current from the indoor unit 2, indicated by an arrow 14, is controlled to be directed toward a spot detected by the human body detector 7.

In the practice of the present invention, the air current 12 generated by the indoor unit 2 is conveyed toward the dust collector 1 via the person 3, and dust raised by movements of the person 3 is accordingly conveyed toward the dust collector 1 by the air current 12. Also, as is known in the art, a direction of the air current 12 as shown in FIG. 1, which flows along walls 11, 13, is changed by the walls 11, 13 without a reduction in wind speed. Accordingly, the dust collecting system according to the present invention can effectively convey dust raised by the movements of the person 3 toward the dust collector 1, which in turn collects the dust by suction.

On the other hand, in the example as shown in FIG. 2 in which the air current 14 from the indoor unit 2 is directly conveyed toward the spot detected by the human body detector 7, dust raised by the movements of the person 3 is conveyed toward a portion of the wall 13 positioned behind the person 3 by the air current 14, and upon impingement on the wall 13, a considerable amount of dust drops to the floor together with a descending air current without reaching the dust collector 1. In this case, the dust collecting efficiency is lowered, compared with a case where no air is discharged from the indoor unit 2, and this result is in agreement with results of experiments conducted by the inventors of this invention.

Accordingly, it is important to control the indoor unit 2 to direct air toward the dust collector 1 via the spot detected by the human body detector 7, as shown in FIG. 1, thereby making it possible to positively collect dust raised by people's movements with the dust collector 1.

Operation of the dust collecting system according to the present invention is discussed hereinafter with reference to a block diagram of FIG. 3 and a flowchart of FIG. 4. The block diagram of FIG. 3 includes a block diagram of the indoor unit 2 of the air conditioner and that of the dust collector 1.

Figure 3:
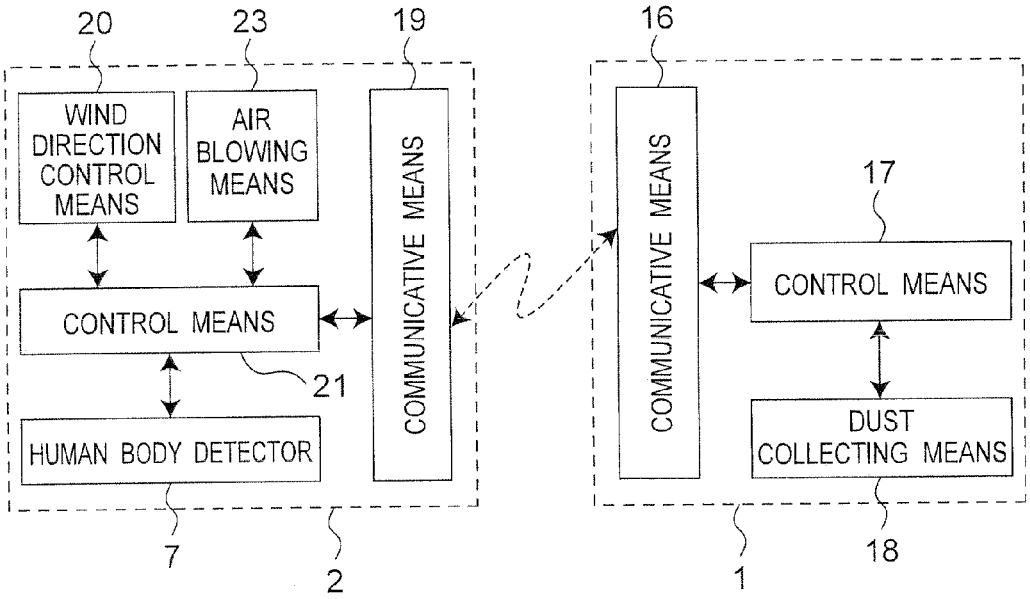
FIG. 3 is a block diagram of the indoor dust collecting system.

As shown in FIG. 3, the indoor unit 2 includes a control means 21 for controlling the entire indoor unit 2, an air blowing means 23 such as a fan for generating an air current, a wind direction control means 20 for driving horizontal wind direction changing blades and a vertical wind direction changing blade, both mounted in a discharge opening formed downstream of the air blowing means 23, to control a wind direction, the human body detector 7 referred to above for detecting a region where a person is present in a room and outputting a signal into the control means 21, and a communicative means 19 for conducting radio communication with the dust collector 1. A communication system of the communicative means 19 may be an infrared communication system, with which air conditioners are generally provided, a communication system with use of radio waves, which may become popular in the field of air conditioners, or any other suitable communication system.

On the other hand, the dust collector 1 includes a control means 17 for controlling the entire dust collector 1, a dust collecting means 18 controlled by the control means 17 to collect dust, which moves with an indoor air current, by suction and discharge air into the room to thereby generate another air current, and a communicative means 16 for conducting radio communication with the indoor unit 2. Each of the control means 17, 21 includes a microcomputer and peripheral circuits.

Figure 4:
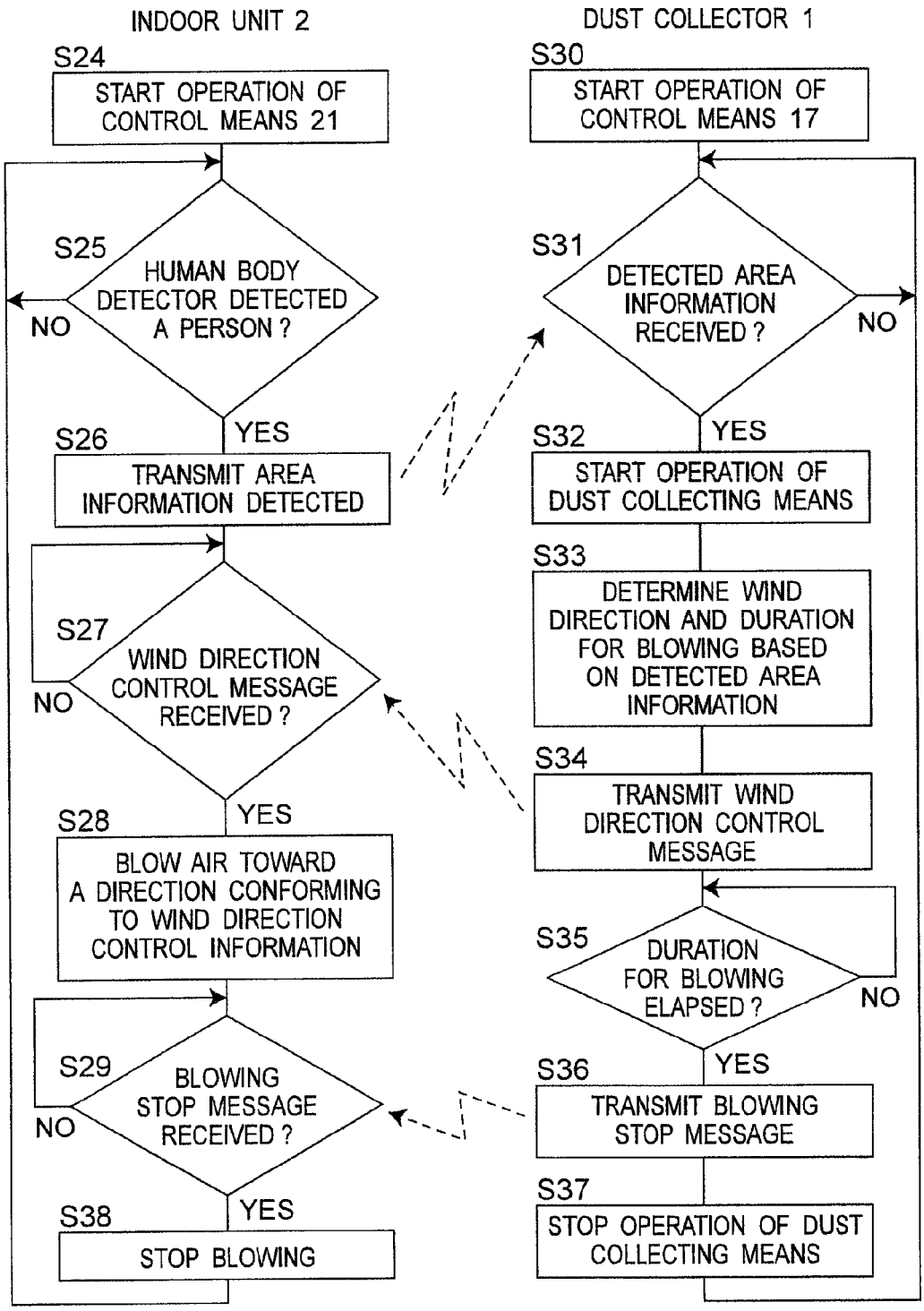
FIG. 4 is a flowchart showing operation of the indoor dust collecting system.

As shown in the flowchart of FIG. 4 depicting operation of the dust collector 1 and that of the indoor unit 2, operation of the control means 21 of the indoor unit 2 starts at step S24 upon energization thereof, and operation of the control means 17 of the dust collector 1 starts at step S30 upon energization thereof. In the indoor unit 2, the program advances to step S25, at which detection of a person by the human body detector 7 is repeatedly conducted.

If a person is detected by the human body detector 7 at step S25, the program advances to step S26, at which the communicative means 19 transmits to the dust collector 1 a telegraphic message including detected area information that is obtained upon determination of an area in a room where a person is present.

On the other hand, in the dust collector 1, when the control means 17 is brought into operation at step S30, the control means 17 is on standby until the telegraphic message including the detected area information reaches. When the communicative means 16 of the dust collector 1 receives the telegraphic message transmitted from the indoor unit 2 at step S26, i.e., when a determination at step S31 is YES, the dust collecting means 18 such as, for example, a fan for sucking dust and discharging air is brought into operation at step S32, followed by step S33, at which a wind direction from the indoor unit 2 and a duration during which air is blown are determined based on the detected area information indicating a place where a person is present. The wind direction is determined with reference to table information stored in, for example, the control means 17 and indicating an optimum wind direction that has been determined in advance based on a position of the dust collector 1, that of the indoor unit 2, and the detected area information. The table information is later explained in detail.

At step S34, the communicative means 16 transmits to the indoor unit 2 a telegraphic message including wind direction information so determined.

The indoor unit 2 waits for transmission of the wind direction message from the dust collector 1 at step S27. If no wind direction message is transmitted from the dust collector 1, a process of step S27 continues, while if the wind direction message from the dust collector 1 is transmitted to the indoor unit 2 (YES at step S27), the program advances to step S28, at which the control means 21 controls the wind direction control means 20 and the air blowing means 23 to blow air toward a direction conforming to the wind direction message.

When the wind direction message is transmitted from the dust collector 1 at step S34, a determination is made at step S35 as to whether the duration for blowing determined at step S33 has elapsed. If a determination is made that the duration has elapsed (YES at step S35), the program advances to step S36, at which the communicative means 16 transmits to the indoor unit 2 a telegraphic message indicating a stop of blowing, followed by step S37, at which operation of the duct collecting means 18 is stopped. Thereafter, the program returns to step S31, at which the control means 17 is on standby until newly detected area information is received.

When the indoor unit 2 starts an air blowing operation at step S28, a determination is made at step S29 as to whether or not the telegraphic message indicating a stop of blowing is received. If such a message is received (YES at step S29), the program advances to step S38, at which an air blowing operation by the air blowing means 23 is stopped. Thereafter, the program returns to step S25, at which a determination is made as to the presence or absence of a new signal from the human body detector 7.

Although a time-out control is not indicated in the flowchart of FIG. 4, it is effective to provide a timer for measuring a predetermined time period at each determination step (for example, step S27 or S29). In this case, if no telegraphic message reaches after a lapse of the time-out period, the program returns to an initial state (for example, step S25) by stopping operation of each means.

Figure 5:
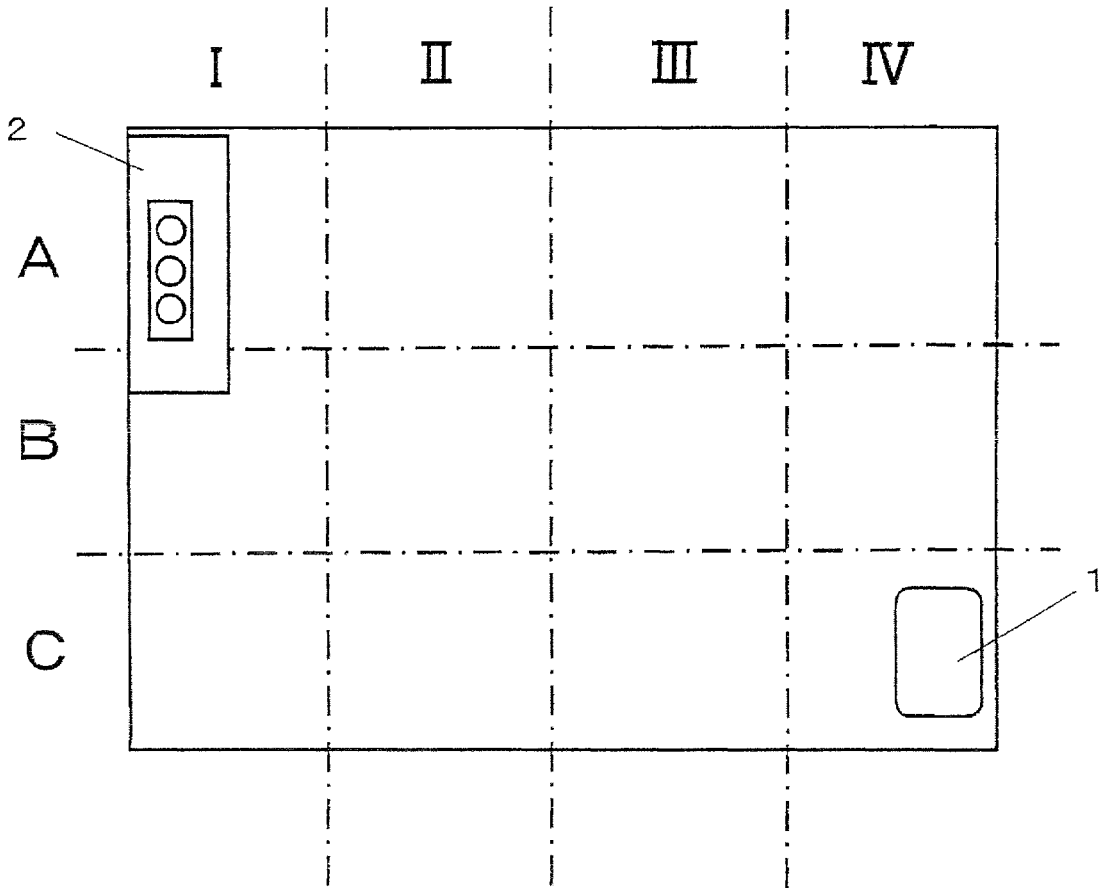
FIG. 5 is a top plan view of a room, showing how to determine the position of an air conditioner and that of a dust collector in the indoor dust collecting system.

An example of the table information for determining the wind direction is explained hereinafter with reference to FIGS. 5 and 6. FIG. 5 is an example of a room in which the dust collector 1 and the indoor unit 2 have been installed with furniture and the like removed.

In FIG. 5, for the sake of convenience, the room is regarded as having a plurality of sections by segmentalizing it into four sections I, II, III and IV in a lengthwise direction and into three sections A, B and C in a widthwise direction. The indoor unit 2 is placed in a section A-I and oriented in a direction of I→IV, while the dust collector 1 is placed in a section C-IV and oriented in a direction of IV→I.

FIG. 6 is an example of table information for determining the wind direction, in which the human body detector 7 is made up of three sensors, as shown in FIGS. 1 and 2. In the table of FIG. 6, the first four columns indicate the position and direction of the dust collector 1 and those of the indoor unit 2, and the columns of the sensors indicate an on/off state of each human body detecting sensor, "ON" indicating a case where the human body detecting sensor detects a person, "OFF" indicating a case where the human body detecting sensor detects no person. The last column indicates the wind direction, i.e., the direction of air to be discharged from the indoor unit 2. Description of the fourth row and subsequent rows is omitted.

The third row of the table of FIG. 6 corresponds to the case of FIG. 1, in which the person 3 is present in front of the rack 4 and within the detectable region 10 and, hence, only the third human body detecting sensor outputs an ON signal, while the first and second human body detecting sensors each output an OFF signal, In this case, as shown in the third row of the "wind direction" column, the wind direction from the indoor unit 2 is controlled leftward, i.e., in a direction shown by the arrows 12.

Although in the example of FIG. 5 the room is segmentalized into 12 (4×3) sections, the number of segmentalization is not limited to this, and the number of the human body detecting sensors should be changed depending on the number of segmentalization of the room. The wind direction determination table of FIG. 6 is a typical example to determine the wind direction and is stored in the control means 17 of the dust collector 1, but the positional information of the dust collector 1 and the indoor unit 2 may be inputted using DIP switches without storing such information in the control means 17. Alternatively, upon determination of the position of the dust collector 1 and that of the indoor unit 2, only a portion of the table of FIG. 6 that is required for determination of the wind direction may be stored in the control means 17 via the communicative means 16 or any other suitable external storage media.

The present invention is further discussed hereinafter, taking a case where an obstacle such as furniture is positioned on a shortest path connecting the indoor unit 2, the spot detected by the human body detector 7, and the dust collector 1. In this case, air-conditioned air from the indoor unit 2 cannot be conveyed to the dust collector 1 via the spot detected by the human body detector 7.

Figure 7:
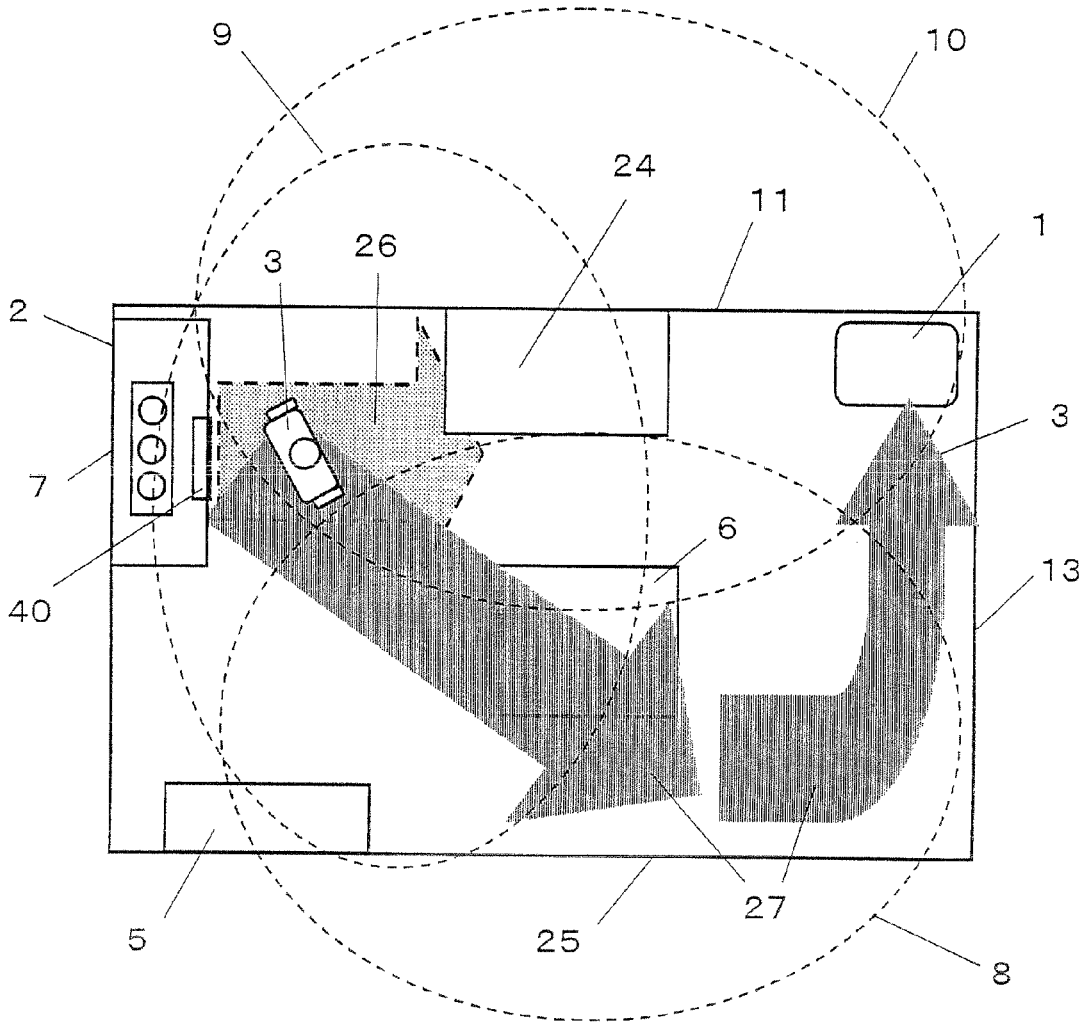
FIG. 7 is a top plan view of a room in which an obstacle is present in an air current created by the indoor dust collecting system.

FIG. 7 depicts a room in which an indoor unit 2 and a dust collector 1 are accommodated, as in the case of FIG. 1 or 2. The room of FIG. 7 differs from that of FIG. 1 or 2 in the position of the dust collector 1 and in that the former is provided with an ultrasonic sensor 40 mounted on the indoor unit 2 and a chest of drawers 24 positioned between the indoor unit 2 and the dust collector 1. In the example of FIG. 7, the ultrasonic sensor 40 is employed as an obstacle detecting means for detecting an obstacle in the room. The ultrasonic sensor 40 acts to emit an ultrasonic wave and detect a reflected wave thereof, and may have a scan mechanism for changing a direction of emission of an ultrasonic wave, or an array of ultrasonic elements from which ultrasonic waves are emitted in different directions by changing input timing of a pulse signal.

If a person 3 is detected in front of the indoor unit 2, as shown in FIG. 7, it appears that air from the indoor unit 2 can be conveyed to the dust collector 1 via the spot where the person 3 has been detected by performing a wind direction control to blow the air from the indoor unit 2 forward (direction indicated by an arrow 26). It is, however, conceivable that a sufficient amount of air cannot reach the dust collector 1 because a chest of drawers 24 is detected by the ultrasonic sensor (obstacle detecting means) 40 in a direction of flow of the air.

In the practice of the present invention, the air is blown out obliquely rightward (obliquely downward in FIG. 7) from the indoor unit 2 in a direction indicated by an arrow 27 so that the air from the indoor unit 2 may be conveyed via the spot of presence of the person 3 to the dust collector 1 along walls 25, 13 while avoiding the obstacles.

That is, if an obstacle or obstacles exist in a path of conveyance of air, use of a detour path to convey air along a wall or furniture is effective, and experiments conducted by the inventors of this invention reveal this fact.

The experiments also reveal that prolonged blowing may lower the dust collecting efficiency. The reason for this is that the prolonged blowing results in a loss of power consumption of the indoor unit 2 and causes dust conveyed from the spot of presence of the person 3 to flow past the dust collector 1.

An effective duration for blowing is a duration terminating when air discharged from the indoor unit 2 reaches the dust collector 1 or its vicinity. Accordingly, the duration for blowing is determined based on a length of the path from the indoor unit 2 to the dust collector 1 via the spot detected by the human body detector 7, and a wind velocity (velocity of a wind generated by the air blowing means 23).

Alternatively, if the dust collector 1 is provided with a dirt sensor or dust sensor, it is also effective that a telegraphic message indicating a stop of blowing is transmitted from the communicative means 16 of the dust collector 1 to the indoor unit 2 based on a time change of a detection value of the dust sensor. For example, the telegraphic message indicating a stop of blowing is transmitted when a time change in the amount of dust detected by the dust sensor has fallen below a predetermined threshold value, or when the amount of dust detected by the dust sensor has fallen below a predetermined threshold value.

Again alternatively, if a path of blowing cannot be determined due to shielding by furniture or the like, it is also effective to perform a control in which no air blowing operation is carried out. This can be realized by incorporating "stop of blowing" in the last column of the wind direction determination table of FIG. 6.

Although in the above-described embodiment an air conditioner is employed as an air blowing apparatus, the present invention is also applicable to an air blower having no temperature control function. Also, in the above-described embodiment, the human body detector 7 and the ultrasonic sensor 40 are employed as a moving body detecting means and an obstacle detecting means, respectively, but an ultrasonic sensor can be used both as a moving body detecting means and an obstacle detecting means.

Various steps as shown in the flowchart of FIG. 4 may be realized by a computer program or a recording medium for storing the same therein.

The present invention is not limited to the above-described embodiment, and any possible changes and modifications should be construed as being included in the present invention.

INDUSTRIAL APPLICABILITY

As described hereinabove, the dust collecting system according to the present invention allows a plurality of apparatuses such as an air conditioner, a dust collector and the like to be used in combination and, hence, the present invention is applicable to various appliances that interact with each other in a room.

LIST OF REFERENCE NUMERALS

1 dust collector
2 indoor unit (air conditioner)
3 person (moving body)
4 rack (furniture)
5 chest of drawers (furniture)
6 table (furniture)
7 human body detector (moving body detecting means)
8, 9, 10 detectable region
11, 13, 25 wall
16, 19 communicative means
17, 21 control means
18 dust collecting means
20 wind direction control means
23 air blowing means
24 chest of drawers (furniture)
40 ultrasonic sensor (obstacle detecting means)

The invention claimed is:

1. An indoor dust collecting system comprising:

an air conditioner, comprising:

an indoor unit comprising an air blower that generates a first air current in a space in which the indoor unit is located, and a wind direction control that controls a direction of the air current generated by the air blower; and a moving body detector that detects a location of a moving body in the space whose movement generates dust in the space, and that transmits a signal to the indoor unit when the moving body is detected; and a dust collector that collects by suction dust moving in an air current in the space and discharges air into the space to generate a second air current;

wherein the wind direction control is controlled so that the first air current is directed in a path from the indoor unit toward the dust collector, the path including the detected location of the moving body in the space.

2. The indoor dust collecting system according to claim 1, wherein the indoor unit comprises an obstacle detector that detects a presence of an obstacle in the path from the indoor unit to the dust collector, and when an obstacle is detected, the path for the first air current is controlled to flow along a wall of the space or a piece of furniture in the space while avoiding the obstacle.

3. The indoor dust collecting system according to claim 1, wherein the moving body detector comprises an infrared radiation sensor capable of detecting infrared radiation emitted from a human body.

4. The indoor dust collecting system according to claim 1, wherein the moving body detector comprises an ultrasonic sensor that emits an ultrasonic wave and detects a reflection of the ultrasonic wave.

5. The indoor dust collecting system according to claim 2, wherein the obstacle detector comprises an ultrasonic sensor that emits an ultrasonic wave and changes a direction of emitting the ultrasonic wave, and detects a reflection of the ultrasonic wave, and the detection of the obstacle is based on a time period between the emission of the ultrasonic wave and the arrival of the reflected ultrasonic wave in different directions.

6. The indoor dust collecting system according to claim 2, wherein when it is determined that the wind direction control cannot control the direction of the first air current to reach the duct collector in a path that includes the detected location of the moving body in the space, the air blower does not generate the first air current.

7. The indoor dust collecting system according to claim 1, wherein a duration during which the first air current is generated is determined based on a length of the path.

8. The indoor dust collecting system according to claim 1, wherein the dust collector further comprises a dust sensor operable to detect an amount of dust, and a duration during which the first air current is generated is determined based on a time change of a detection value from the dust sensor.

9. A dust collector operable to cooperate with an indoor unit of an air conditioner, the indoor unit comprising an air blower that generates a first air current in a space in which the indoor unit is located, and a wind direction control that controls a direction of the air current generated by the air blower; and a moving body detector that detects a location of a moving body in the space whose movement generates dust in the space, and that transmits a signal to the indoor unit when the moving body is detected, the dust collector comprising:

a communication unit that transmits to and receives from the indoor unit a message in a form identical to that used by a remote controller that remotely controls the indoor unit;

a dust collector that collects by suction dust moving in an air current in the space and discharges air into the space to generate a second air current; and a control unit operable to control the wind direction control via the communication unit so that the first air current is directed in a path from the indoor unit toward the dust collector, the path including the detected location of the moving body in the space.

10. A non-transitory computer readable medium having a program recorded thereon, the program instructing a computer to control the indoor dust collecting system according to claim 1.

11. A non-transitory computer readable medium having a program recorded thereon, the program instructing a computer to control the dust collector according to claim 9.

* * * * *